United States Patent [19]

Dittman et al.

[11] 4,001,024

[45] Jan. 4, 1977

[54] METHOD OF MULTI-LAYER COATING

[75] Inventors: Donald Allen Dittman; Francis Armand Rozzi, both of Rochester, N.Y.

[73] Assignee: Eastman Kodak Company, Rochester, N.Y.

[22] Filed: Mar. 22, 1976

[21] Appl. No.: 668,883

[52] U.S. Cl. ..... 96/87 R; 96/85; 427/402; 427/414; 427/420

[51] Int. Cl.[2] ..... G03C 1/74; B05D 1/34

[58] Field of Search ..... 427/411, 414, 434 A, 427/420, 402; 96/87 R, 85; 118/DIG. 4

[56] References Cited

UNITED STATES PATENTS

| | | | |
|---|---|---|---|
| 2,761,791 | 9/1956 | Russell | 96/87 R |
| 2,932,855 | 4/1960 | Bartlett et al. | 427/131 X |
| 2,975,754 | 3/1961 | Wright | 118/407 |
| 3,206,323 | 9/1965 | Miller et al. | 96/85 |
| 3,508,947 | 4/1970 | Hughes | 118/324 X |
| 3,573,965 | 4/1971 | Ishiwata et al. | 96/87 R X |
| 3,749,053 | 7/1973 | Timson | 118/50 |

FOREIGN PATENTS OR APPLICATIONS

| | | | |
|---|---|---|---|
| 1,417,765 | 12/1975 | United Kingdom | 96/87 R |
| 929,905 | 5/1963 | United Kingdom | 96/87 R |

*Primary Examiner*—Ralph Husack
*Attorney, Agent, or Firm*—A. P. Lorenzo

[57] ABSTRACT

The simultaneous high speed application of a plurality of liquid coating compositions to a moving web by the method of multi-layer bead coating is improved by coating the lowermost layer as a thin layer formed from a low viscosity coating composition and coating the layer immediately above the lowermost layer as a thicker layer of higher viscosity such that vortical action of the coating bead is confined to the lowermost layer and the layer immediately above it. By this means, intermixing of the coating composition forming the lowermost layer with the coating composition forming the layer immediately above it occurs, but all other layers are coated in discrete form. The method is especially useful in the manufacture of multi-layer photographic films and papers.

15 Claims, 3 Drawing Figures

METHOD OF MULTI-LAYER COATING

This invention relates in general to the coating of liquid coating compositions on support materials and in particular to improvements in the method of multi-layer bead coating for simultaneously applying a plurality of layers of liquid coating compositions to a moving web of sheet material.

U.S. Pat. No. 2,761,791 describes the method of multi-layer bead coating whereby a plurality of liquid coating compositions are simultaneously applied to a web while maintaining distinct layer relationship. In this method, the surface of the web to be coated is moved across and in contact with a coating bead in which individual layers of coating composition exist in distinct layer relationship, and as a result of such contact there is deposited on the moving web a coating made up of a plurality of distinct superposed layers. The coating compositions are continuously fed to the coating bead from a suitable coating device, such as a slide hopper or extrusion hopper, positioned in close proximity to the surface of the moving web in order to maintain the coating bead in bridging relationship between the web and the lip of the coating device. The thickness of the coating which can be successfully laid down on the web is determined by the action of the coating bead and will vary with such factors as the speed of the web and the physical properties of the coating compositions.

One disadvantage in the process of multi-layer bead coating described above is that it is ordinarily necessary to form the lowermost layer, i.e., the layer which comes into contact with the web, from a coating composition of low viscosity and to coat it with a high wet coverage. Thus, for example, it is typical in such method for the lowermost layer to be formed from a coating composition with a viscosity in the range from about 3 to about 10 centipoises and to provide a wet coverage in the range from about 40 to about 100 cubic centimeters of coating composition per square meter of support. A lowermost layer having these wet coverage and viscosity characteristics is utilized because a vortical action takes place within a coating bead, and when the lowermost layer is of a substantial thickness and formed from a coating composition of low viscosity this vortical action is retained entirely within the lowermost layer so that intermixing of the composition of the lowermost layer with that of the layer immediately above is avoided, even at high coating speeds. (The term "vertical action" is used herein to refer to a turbulent shearing and mixing action not necessarily involving the formation of eddies. The exact nature of this action is dependent upon numerous factors, including the physical characteristics of the coating compositions and the speed of coating.) However, operation of the process with the aforesaid wet coverage and viscosity in the lowermost layer can be significantly disadvantageous since a thick layer of low viscosity coating composition comprises a large amount of water (or other liquid vehicle) which must subsequently be removed in drying the coated material. To meet the conditions necessary for successful multi-layer bead coating, substantial dilution of the coating composition used to form the lowermost layer is typically necessary. The greater the extent of dilution, the greater the amount of water which must subsequently be removed in the drying operation and if the amount of water to be removed becomes too great it will exceed the capacity of the dying equipment. Under such conditions, the speed of coating will be controlled by the setting and/or drying steps and it may be necessary to operate at an undesirably low speed in order not to exceed the setting and/or drying capacity. Additionally, greater capacity in the equipment used for preparing the coating compositions is needed if such compositions must be diluted in order to facilitate coating, and this adds significantly to equipment costs. Accordingly, it would be highly desirable to minimize the extent to which dilution must be utilized in preparing the coating composition intended to form the lowermost layer of the product, or to avoid the need for dilution entirely.

The limitations of multi-layer bead coating with respect to the viscosity and thickness requirements of the lowermost layer are described in U.S. Pat. No. 3,508,947 and it is pointed out in this patent that the method does not provide a sufficient degree of freedom with respect to layer orientation since the relative thickness and viscosity requirements of the individual layers necessary to facilitate coating are frequently not in accord with product requirements. The resulting need to dilute certain coating compositions and the disadvantages this entails are also discussed. A solution to this problem is provided by U.S. Pat. No. 3,508,947 in that the method of multi-layer curtain coating described in the patent is not similarly restricted.

As pointed out hereinabove, multi-layer bead coating is typically carried out under conditions such that there is high wet coverage in the lowermost layer, but it has also been carried out heretofore with low wet coverage in the lowermost layer by resorting to the use of very high wet coverage in the layer immediately above the lowermost layer. It is believed that this layer arrangement creates conditions such that vortical action is confined entirely within the layer immediately above the lowermost layer so that interlayer mixing does not occur. However, in view of the very high wet coverage needed in the layer immediately above the lowermost layer, this technique suffers from the same disadvantage described above, namely the need to remove large quantities of water in the drying operation, and is also undesirably limited in respect to the range of speeds that can be successfully employed.

In accordance with the present invention, the method of multi-layer bead coating is carried out at a web speed of at least 100 centimeters per second with a lowermost layer which is thin and of low viscosity and with the layer next above the lowermost layer being of higher viscosity and of a sufficient thickness that vortical action of the coating bead is confined within the lowermost layer and the layer next above it. This results in some intermixing of the coating composition forming the lowermost layer with the coating composition forming the layer next above it. However, in the process of this invention the coating composition used to form the lowermost layer is so chosen that this interlayer mixing is not harmful to the product being produced. Since vortical action of the coating bead is confined within the two bottom layers, i.e., the lowermost layer and the layer next above it, one or more layers located above these two layers can be simultaneously coated while maintaining distinct layer relationship. Thus, the capability of the multi-layer bead coating method to provide simultaneous coating of a plurality of coating compositions, e.g., ten or more, while maintaining distinct layer relationship is retained in the method of this invention except in regard to the two bottom layers which are designed to be coated from coating compositions such that interlayer mixing can be tolerated.

While the method of this invention is useful in any instance where it is desired to simultaneously apply a plurality of layers of liquid coating compositions to a sheet material, it is especially useful in the manufacture of photographic elements and will be described hereinafter with reference to the coating of such elements. Coating compositions employed in the preparation of photographic elements are typically aqueous solutions of hydrophilic colloids. Representative examples of such coating compositions are silver halide emulsions in which the hydrophilic colloid in gelatin. Thus, a typical example of the method of this invention is a process in which the coating compositions making up the separate layers of the product are gelatino/silver halide emulsions. In adapting the method of this invention to the coating of such emulsions, there is a wide range of choice with respect to the selection of materials which can be used to form the lowermost layer when the layer next above it is to be formed from a gelatino/silver halide emulsion. For example, the coating composition used to form the lowermost layer can be any of a variety of compositions which will be compatible with the gelatino/silver halide emulsion and will not harm the product as a result of the interlayer mixing that occurs in the process between the composition of the lowermost layer and that of the layer next above it. Examples of useful coating compositions for forming the lowermost layer in such instance are low viscosity gelatin solutions, low viscosity gelatin solutions containing a surfactant, low viscosity solutions of photographically inert materials such as dispersing agents, solvents, polymers, thickening agents, surfactants, and mixtures thereof. It is also feasible for the lowermost layer to be formed from the gelatin/silver halide emulsion that is used to form the layer next above it, except that such emulsion would be diluted to the appropriate low viscosity in order to be used to form the lowermost layer. In a further particular embodiment of the invention, the lowermost layer is formed from a "blank dispersion", i.e., a dispersion of a coupler solvent, such as the high-boiling water-insoluble crystalloidal materials described in U.S. Pat. No. 2,322,027, in a hydrophilic colloid such as gelatin.

DETAILED DESCRIPTION OF THE DRAWINGS

Figure 1:
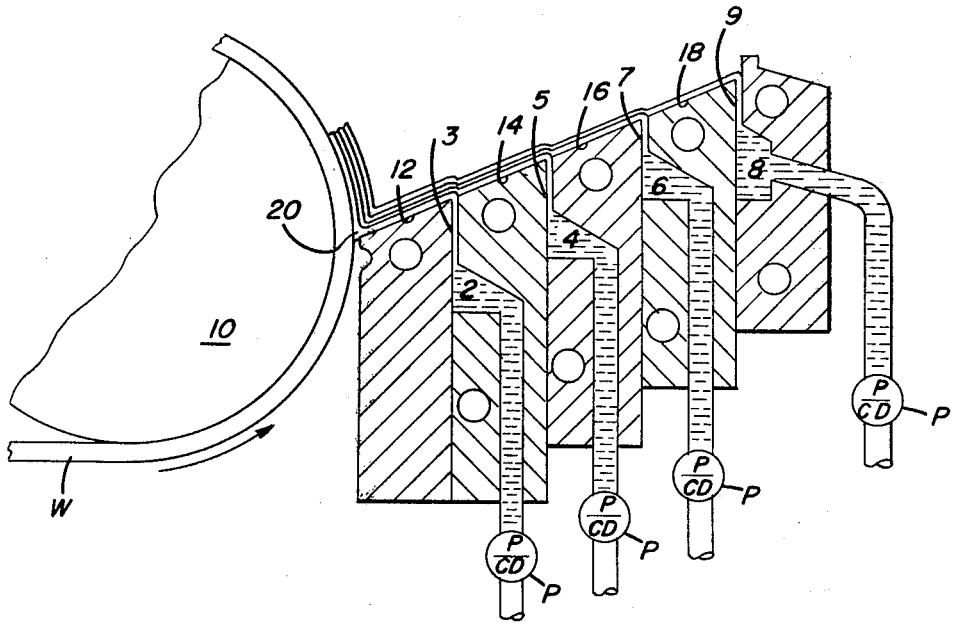
FIG. 1 is a sectional view of a coating hopper which can be used in carrying out the method of this invention.

FIG. 1 illustrates a multi-slide hopper suitable for use in carrying out the method of this invention. The hopper illustrated comprises four separate slide surfaces that would be utilized in the method of this invention in the manufacture of a product requiring three distinct layers. In carrying out the method with this hopper, coating composition intended to form the lowermost layer is continuously pumped by a suitable metering pump P at an appropriate rate into a cavity 2 from which it passes through a narrow vertical slot 3 out onto a downwardly inclined slide surface 12 down which it flows by gravity. In a similar manner, other coating compositons intended to form the layers above the lowermost layer are continuously pumped into cavities 4, 6, and 8 and passed through narrow vertical slots 5, 7, and 9, respectively, onto slide surfaces 14, 16, and 18 respectively, down which they flow by gravity. The layers of coating composition flowing down slide surfaces 12, 14, 16 and 18 flow into coating bead 20 and as moving web W, passing around backing roll 10, moves across and in contact with coating bead 20 it picks up the four layers of coating composition. As previously described herein, the viscosity and thickness of the lowermost layer, i.e., the layer in contact with slide surface 12, and of the layer immediately above it, i.e., the layer in contact with slide surface 14, are so selected that interlayer mixing takes place between these two layers but vortical action of the coating bead 20 is confined to these two layers so that no interlayer mixing occurs with the layers above.

Figure 2:
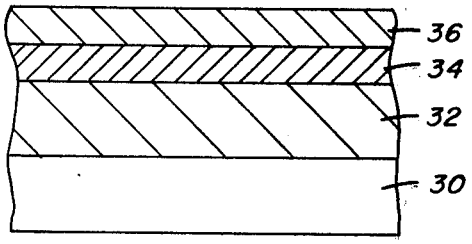
FIG. 2 is an enlarged fragmentary section of a photographic element illustrating coating layers which are free of interlayer mixing.

Multi-layer bead coating, as carried out prior to the present invention, typically utilized an arrangement of layer thickness such as is illustrated in FIG. 2. This figure illustrates the coated layers in a wet state for a three-layer product. The arrangement of layers is such that layer 32, which is in contact with web 30, is considerably thicker than layers 34 and 36 which are above layer 32, By this means, the vortical action of the coating bead is retained within layer 32 so that there is no interlayer mixing between layer 32 and layer 34 or between layer 34 and layer 36.

Figure 3:
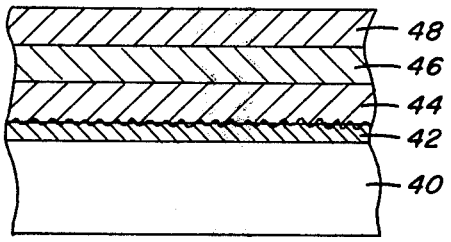
FIG. 3 is an enlarged fragmentary section of a photographic element illustrating interlayer mixing between the lower most coated layer and the layer immediately above it.

FIG. 3 illustrates a typical arrangement of layer thickness in the coating method of this invention in which the lowermost layer is thin and of low viscosity. As shown in this figure, layer 42, which is in contact with web 40, is very thin. Because of this, vortical action of the coating bead extends into layer 44 and there is interlayer mixing between layers 42 and 44, as indicated in FIG. 3 by the wavy line separating these layers. However, the thickness and viscosity of layers 42 and 44 is such that vortical action of the coating bead is confined to these two layers only and there is no interlayer mixing between layers 44 and 46 or between layers 46 and 48. Manufacture of the three-layer product in accordance with the prior art method of multilayer bead coating involves use of a slide hopper with three slide surfaces, whereas manufacture of the same product by the method of this invention involves use of a slide hopper with four slide surfaces. It should be noted, however, as illustrated by FIGS. 2 and 3, that the combined wet thickness of layers 42 and 44 can be made substantially less than the thickness of layer 32. By using the method of this invention, layer 44 need not be thick or of low viscosity, as is required for layer 32 coated by the method of the prior art. In fact, the combined amount of liquid vehicle in layers 42 and 44 together can be substantially less than in layer 32 alone, so that the drying load is significantly reduced. This is the case even though layer 42 must be of low viscosity since it can be very thin.

In view of the above, it will be apparent that the method of this invention represents an important improvement in the method of multi-layer bead coating described in U.S. Pat. No. 2,761,791. In contrast with the method of U.S. Pat. No. 2,761,791, in carrying out the method of this invention, an additional coating composition is employed and it is coated, as the lowermost layer of the stratified layer arrangement, using an appropriate coating device such as a slide hopper having one more slide surface than the hopper that would be used in carrying out the method of U.S. Pat. No. 2,761,791. This additional coating composition is of low viscosity and is applied as a very thin layer. The layer next above this lowermost layer can then be of a substantially higher viscosity than is required in the lowermost layer when the prior art method is used. Accordingly, dilution of the coating composition forming this layer can be entirely avoided, or at least significantly reduced.

The method of this invention has a number of significant advantages as compared with the prior art method of multi-layer bead coating. Thus, for example, since the coating composition forming the lowermost layer is of low viscosity, it is effective in "wetting" the surface of the web, and thereby reduces the propensity for coating defects resulting from inability to adequately "wet" the web. Substantial reduction in drying load is achieved since the lowermost layer is very thin, and accordingly, adds little to the total drying load, whereas the layer immediately above the lowermost layer can be formed from a coating composition which is quite viscous and therefor requires little or no dilution. Reducing or eliminating the dilution of this coating composition also provides for improved "setting" of the layer after coating and results in a coating which is more resistant to "remelt". Since the drying load is decreased in comparison with the prior art method of multi-layer bead coating, increased coating speeds can be utilized without providing greater drying capacity. Another advantage of the method of this invention is reduction in the number of coating defects, such as skip and mottle defects, which typically occur in high speed coating. Moreover, the ability of the thin low viscosity bottom layer to act as a "shield" for layers above it, and thereby reduce the tendency for particles or crystals to be caught on the lip of the coating hopper, or to grow on the lip, avoids many defects attributable to disturbances at the lip.

The method of this invention is distinct from prior art multi-layer bead coating in that is involves the application of an additonal coating composition. Thus, for example, if the product being manufactured is one which requires three distinct layers, in the prior art method three coating compositions are utilized but in the method of this invention four coating compositions are utilized with the fourth composition serving to form the lowermost layer. The problem of reducing the high drying loads which are an inherent disadvantage of prior art multi-layer bead coating is solved, most unexpectedly, by the introduction of an additonal coating composition which in and of itself necessarily adds to the drying load. This is made possible by the fact that the use of the additional coating composition, in accordance with the principles described herein, permits a substantially greater amount of liquid vehicle to be eliminated from the second layer than is added by introduction to the stratified layer arrangement of the thin lowermost layer. In summary, the addition of an extra layer which would be expected to add to drying load does just the opposite and significantly reduces It. The advantages of the invention are especially great at very high coating speeds because operation at such speeds involves very high drying loads and, accordingly, the capability of the invention for reducing drying load becomes especially significant.

In a particular embodiment of the present invention, the gelatino/silver halide emulsion intended to form the lowermost layer of the photographic element being coated is split into two portions, one several times greater in amount than the other. The small portion is diluted to a low viscosity, for example a viscosity of five centipoises, and used to form the lowermost layer in the coating operation, i.e., the layer which contacts the web. The large portion is utilized without dilution to form the layer immediately above the lowermost layer. Thus, instead of diluting all of this emulsion, as would typically be required when coating by multilayer bead coating in accordance with the prior art, only a small fraction of it needs to be diluted and this substantially reduces total drying load. Intermixing of the two bottom layers is not detrimental to the product since both are of identical chemical composition. All layers located above these two are coated in discrete layer relationship. Accordingly, by splitting the emulsion into two parts and controlling the viscosities and wet coverages of the resulting layers in accordance with the principles described herein, decreased drying load at a given coating speed, or conversely increased speed at a given drying load, can be readily achieved.

Any coating apparatus suitable for use in multilayer bead coating can be used in the method of this invention. Examples of such apparatus are described in detail in U.S. Pat. No. 2,761,791.

The method of this invention can be utilized to caot any material or mixture of materials which can be put in liquid form, for example, in the form of a solution, a dispersion, or a suspension. In many instances where this method finds application, the coating composition is an aqueous composition but other liquid vehicles of either an organic or inorganic nature, can also be utilized and are fully within the contemplation of this invention. The respective layers can be formed of the same or different liquid coating compositions and these coating compositions can be either miscible or immiscible with one another.

As indicated hereinbefore, the method of this invention is especially useful in the photographic art for manufacture of multilayer photographic elements, i.e., elements comprised of a support coated with a plurality of superposed layers of photographic coating compositions. The number of individual layers may be as high as ten or more. In the photographic art, the liquid coating compositions utilized are usually aqueous compositions but organic compositions can also be employed. The individual layers applied in the manufacture of photographic elements must be exceedingly thin, i.e., a wet thickness which is a maximum of about 0.015 centimeter and generally is far below this value and may be as low as about 0.0001 centimeter. In addition the layers must be of extremely uniform thickness, with the maximum variation in thickness uniformity typically being plus or minus five percent and in some instances as little as plus or minus one percent. In spite of these exacting requirements, the method of this invention is of great utility in the photographic art since it permits the layers to be coated simultaneously while maintaining the necessary distinct layer relationship between all layers except the bottom two layers in which intermixing is permitted, and fully meeting the requirements of extreme thinness and extreme uniformity in layer thickness.

The method of this invention is suitable for use with any liquid photographic coating composition and can be employed with any type of photographic support and it is, accordingly, intended to include all such coating compositions and supports as are utilized in the photographic art within the scope of these terms, as employed herein and in the appended claims.

The term "photographic " normally refers to a radiation sensitive material, but not all of the layers presently applied to a support in the manufacture of photographic elements are, in themselves, radiation sensitive. For example, subbing layers, pelloid protective layers, filter layers, antihalation layers, etc. are often applied separately and/or in combination and these particular layers are not radiation sensitive. The present invention relates also to the application of such layers, and the term "photographic coating composition" as employed herein, is intended to include the composition from which such layers are formed. Moreover, the invention includes within its scope all radiation-sensitive materials, including electrophotographic materials and materials sensitive to invisible radiation as well as those sensitive to visible radiation. While, as mentioned hereinbefore, the layers are generally coated from aqueous media, the invention is not so limited since other liquid vehicles are known in the manufacture of photographic elements and the invention is also applicable to and useful in coating from such vehicles.

More specifically, the photographic layers coated according to the method of this invention can contain light-sensitive materials such as silver halides, zinc oxide, titanium dioxide, diazonium salts, light-sensitive dyes, etc., as well as other ingredients known to the art for use in photographic layers, for example, matting agents such as silica or polymeric particles, developing agents, mordants, and materials such as are disclosed in U.S. Pat. No. 3,297,446. The photographic layers can also contain various hydrophilic colloids. Illustrative of these colloids are proteins, e.g., gelatin; protein derivatives; cellulose derivatives; polysaccharides such as starch; sugars, e.g., dextran; plant gums; etc.; synthetic polymers such as polyvinyl alcohol, polyacrylamide, and polyvinylpyrolidone; and other suitable hydrophilic colloids such as are disclosed in U.S. Pat. No. 3,297,446. Mixture of the aforesaid colloids may be used, if desired.

In the practice of this invention, various types of photographic support may be used to prepare the photographic elements. Suitable supports include film base, e.g., cellulose nitrate film, cellulose acetate film, polyvinyl acetal film, polycarbonate film, polystryene film, polyethylene terephthalate film and other polyester films; paper; glass; cloth; and the like. Paper supports coated with alpha-olefin polymers, as exemplified by polyethylene and polypropylene, or with other polymers, such as cellulose organic acid esters and linear polyesters, may also be used if desired.

Various types of surfactants can be used to modify the surface tension and coatability of photographic coating compositons in accordance with this invention. Useful surfactants include saponin; non-ionic surfactants such as polyalkylene oxides, e.g., polyethylene oxides, and the water-soluble adducts of glycidol and alkyl phenol; anionic surfactants such as alkylaryl polyether sulfates and sulfonates; and amphoteric surfactants such as arylalkyl taurines, N-alkyl and N-acyl beta-amino propionates; alkyl ammonium sulfonic acid betaines, etc. Illustrative examples of useful surfactants of these types are disclosed in British Pat. No. 1,022,878 and U.S. Pat. Nos. 2,739,891; 3,026,202 and 3,133,816.

To enhance the uniformity of the coated layers applied to the surface of the support in accordance with this invention it is, in some instances, also desirable to modify the surface characteristics of the support. Thus, certain supports have surfaces which are not readily wet by certain coating compositions and where this is the case the uniformity of the coated layers can be significantly improved if the surface of the support is prewet before it reaches the coating zone. This prewetting operation does not necessarily require the application of a liquid to the surface, but can also be carried out by steaming the surface, passing it through a vacuum chamber in the presence of steam, etc. This prewetting tends to reduce the air barrier on the surface of the support as well as to reduce any natural repellency the surface may have for a given coating composition. In addition to the use of prewetting techniques, or as an alternative to the use of prewetting techniques, suitable apparatus can be employed to impart an electrostatic charge to the support prior to application of the coating composition. This serves to facilitate the uniform application of the coating composition to the support, especially at high coating speeds.

In practicing the method of this invention, the web speed employed is at least 100 centimeters per second and may be substantially greater than this, such as web speeds of up to 600 centimeters per second and higher. A preferred range of web speeds is from about 150 to about 500 centimeters per second.

As described hereinabove, in the method of this invention, the lowermost layer is very thin and formed from a coating composition of low viscosity and the layer immediately above it is thicker and of higher viscosity. The selection of thickness and viscosity for each of these layers is controlled by the criterion that vortical action of the coating bead is to be confined within these two layers so that all layers above will be coated out in discrete layer relationship and interlayer mixing will occur only between the lowermost layer and the layer immediately above it. The optimum thickness and viscosity for each of the two lower layers will depend on the particular compositions being coated and other factors such as the speed of coating and the type of support. In practicing the invention, the lowermost layer will typically be formed from a coating composition with a viscosity in the range from about 1 to about 8 centipoises, and preferably from about 3 to about 5 centipoises, and will typically be coated at a wet coverage in the range from about 2 to about 12 cubic centimeters of coating composition per square meter of support, and preferably in the range from about 5 to about 10 cubic centimeters of coating composition per square meter of support. The layer immediately above the lowermost layer will typically be formed from a coating composition with a viscosity in the range from about 10 to about 100 centipoises, and preferably from about 30 to about 70 centipoises, and will typically be coated at a wet coverage in the range from about 15 to about 50 cubic centimeters of coating composition per square meter of support, and preferably in the range from about 20 to about 35 cubic centimeters of coating composition per square meter of support.

As employed herein, viscosity values in centipoises refer to viscosities at 40° C as measured by a rolling ball viscometer described in Industrial and Engineering Chemistry, Analytical Edition, Volume 15, No. 3, Pages 212–218 (1943) with values converted to centipoises with a calibrated conversion table.

In order to establish that a particular set of operating conditions results in interlayer mixing between the lowermost layer and the layer immediately above it, but coating of all other layers in distinct layer relationship, one can carry out a simple test procedure in which a coloring agent, e.g., a dye or pigment, which is readily visible is added to some of the coating compositions but not to others or in which coloring agents of different colores are added to different coating compositions. For example, one can add carbon black to a gelatin coating compositon forming a particular layer while using a clear gelatin solution that is free of carbon black for forming the adjacent layers and determine whether interlayer mixing has occured by inspection of magnified cross-sections of the coated material or by preparation of photomicrographs. Consider, for example, the coating of five different coating compositions forming respectively layers A, B, C, D and E with layer A being uppermost and layer E being lowermost. The coating compositions forming layers B and E are gelatin solutions containing carbon black while the coating compositions forming layers A, C and D are clear gelatin solutions that are free of carbon black. As a result of coating in accordance with the principles described herein, coated layers A and C will be free of carbon black, while coated layers B, D and E will contain carbon black. The carbon black in layer D will be present because of interlayer mixing between layers D and E.

The invention is further illustrated by the following examples of its practice.

EXAMPLE 1

A multiple-slide hopper similar to that shown in FIG. 1 was used to simultaneously coat four layers of liquid coating compositions on a moving web, 104 centimeters in width, of baryta-coated photographic paper. The web was advanced at a speed of 203 centimeters per second. The coating compositions were as follows:

Lowermost layer: an aqueous gelatin solution containing an anionic surfactant and having a viscosity of 3.1 centipoises at 40° C coated at a wet coverage of 4.7 cubic centimeters per square meter of web surface.

Second layer: an aqueous gelatin solution, containing photographic developing agents and hardening agents, having a viscosity of 23 centipoises at 40° C coated at a wet coverage of 32 cubic centimeters per square meter of web surface.

Third layer: a black-and-white silver halide gelatin emulsion having a viscosity of 25 centipoises at 40° C coated at a wet coverage of 25 cubic centimeters per square meter of web surface.

Top layer: an aqueous gelatin solution, containing a matte slurry, surfactant and lubricant, having a viscosity of 45 centipoises at 40°C coated at a wet coverage of 6.6 cubic centimeters per square meter of web surface.

Under the above conditions, interlayer mixing occurs between the lowermost layer and the second layer but not between the second layer and third layer or between the third layer and top layer.

EXAMPLE 2

A multiple-slide hopper similar to that shown in FIG. 1 but having only three slide surfaces was used to simultaneously coat three layers of liquid coating compositions on a moving web, 104 centimeters in width, of polyethylene-coated photographic paper covered with a dried gelatin layer containing carbon and developing agents. The web was advanced at a speed of 254 centimeters per second. The coating compositions were as follows:

Lowermost layer: an aqueous gelatin solution having a viscosity of 3.1 centipoises at 40° C coated at a wet coverage of 4.7 cubic centimeters per square meter of web surface.

Second layer: a black-and-white silver halide gelatin emulsion having a viscosity of 52 centipoises at 40° C coated at a wet coverage of 16.5 cubic centimeters per square meter of web surface.

Top layer: a black-and-white silver halide gelatin emulsion having a viscosity of 7.7 centipoises at 40° C coated at a wet coverage of 10.6 cubic centimeters per square meter of web surface.

Under the above conditions, interlayer mixing occurs between the lowermost layer and the second layer but not between the second layer and the top layer.

Similar results are obtained using different viscosities and wet coverages in the lowermost layer, for example, a viscosity of 4 centipoises and a wet coverage of 10 cubic centimeters per square meter of web surface or a viscosity of 6 centipoises and a wet coverage of 8 cubic centimeters per square meter of web surface.

EXAMPLE 3

Example 2 was repeated except that the coating composition used to form the lowermost layer was a "blank dispersion", consisting of coupler solvent and surfactant dispersed in gelatin, having a viscosity of 3.1 centipoises at 40° C coated at a wet coverage of 4.7 cubic centimeters per square meter of web surface. Under these conditions, interlayer mixing occurs between the lowermost layer and the second layer but not between the second layer and the top layer.

EXAMPLE 4

Example 2 was repeated except that the coating composition used to form the lowermost layer was a diluted portion of the black-and-white silver halide gelatin emulsion used to form the second layer having a viscosity of 3.1 centipoises at 40° C coated at a wet coverage of 4.7 cubic centimeters per square meter. Under these conditions, interlayer mixing occurs between the lowermost layer and the second layer but not between the second layer and the top layer.

EXAMPLE 5

A multiple-slide hopper similar to that shown in FIG. 1 but having seven slide surfaces was used to simultaneously coat seven layers of liquid coating compositions on a moving web of polyolefin-coated photographic paper. The web was advanced at a speed of 355 centimeters per second. The coating compositions were as follows:

Lowermost layer: an aqueous gelatin solution having a viscosity of 3.1 centipoises at 40° C coated at a wet coverage of 7 cubic centimeters per square meter of web surface.

Second layer: a blue-sensitive silver halide gelatin emulsion having a viscosity of 34 centipoises at 40° C coated at a wet coverage of 18 cubic centimeters per square meter of web surface.

Third layer: an aqueous gelatin solution having a viscosity of 70 centipoises at 40° C coated at a wet coverage of 5 cubic centimeters per square meter of web surface.

Fourth layer: a green-sensitive silver halide gelatin emulsion having a viscosity of 34 centipoises at 40° C coated at a wet coverage of 17 cubic centimeters per square meter of web surface.

Fifth layer: a gelatin solution containing a UV absorbing dye and having a viscosity of 40 centipoises at 40° C coated at a wet coverage of 15 cubic centimeters per square meter of web surface.

Sixth layer: a red-sensitive silver halide gelatin emulsion having a viscosity of 60 centipoises at 40° C coated at a wet coverage of 16 cubic centimeters per square meter of web surface.

Top layer: an aqueous gelatin solution containing a surfactant and having a viscosity of 70 centipoises at 40° C coated at a wet coverage of 8 cubic centimeters per square meter of web surface.

Under the above conditions, interlayer mixing occurs between the lowermost layer and the second layer but not between any other layers.

EXAMPLE 6

Example 5 was repeated except that the coating composition used to form the lowermost layer was a "blank dispersion", consisting of coupler solvent and surfactant dispersed in gelatin, having a viscosity of 3.1 centipoises at 40° C coated at a wet coverage of 7 cubic centimeters per square meter of web surface. Under these conditions, interlayer mixing occurs between the lowermost layer and the second layer but not between any other layers.

EXAMPLE 7

Example 5 was repeated except that the coating composition used to form the lowermost layer was a diluted portion of the blue-sensitive silver halide gelatin emulsion used to form the second layer having a viscosity of 3.1 centipoises at 40° C and a wet coverage of 7 cubic centimeters per square meter of web surface. Under these conditions, interlayer mixing occurs between the lowermost layer and the second layer but not between any other layers.

EXAMPLE 8

A comparison of the method of multi-layer bead coating of this invention with the method of multi-layer bead coating described in U.S. Pat. No. 2,761,791, in which the speed at which the web was advanced was the same in each instance, was performed as described below. The method of U.S. Pat. No. 2,761,791 was carried out using a slide hopper similar to that shown in FIG. 1 herein but having two slide surfaces while the method of this invention was carried out using a slide hopper similar to that shown in FIG. 1 herein but having three slide surfaces. In each case the speed at which the web was advanced was 190 centimeters per second and the support was a polyethylene-coated photographic paper. The coating compositions were as follows:

1. Method of U.S. Pat. No. 2,761,791

Bottom layer: a black-and-white silver halide gelatin emulsion having a viscosity of 8.3 centipoises at 40° C coated at a wet coverage of 40.1 cubic centimeters per square meter of web surface.

Top layer: a black-and-white silver halide gelatin emulsion having a viscosity of 7.7 centipoises at 40° C coated at a wet coverage of 10.6 cubic centimeters per square meter of web surface.

2. Method of this invention

Bottom layer: an aqueous gelatin solution having a viscosity of 3.1 centipoises at 40° C coated at a wet coverage of 4.7 cubic centimeters per square meter of web surface.

Middle layer: the composition was the same black-and-white silver halide gelatin emulsion used to form the bottom layer in the test described above illustrating the method of U.S. Pat. No. 2,761,791 but concentrated to a viscosity of 52 centipoises at 40° C and coated at a wet coverage of 16.5 cubic centimeters per square meter of web surface.

Top layer: the top layer was the same as the top layer in the test described above illustrating the method of U.S. Pat. No. 2,761,791, that is, a black-and-white silver halide gelatin emulsion having a viscosity of 7.7 centipoises at 40° C coated at a wet coverage of 10.6 cubic centimeters per square meter of web surface.

In carrying out the test illustrating the method of U.S. Pat. No. 2,761,791 no interlayer mixing took place, whereas in carrying out the test illustrating the method of this invention interlayer mixing took place between the bottom and middle layers but not between the middle and top layers. After completion of the coating and drying operations, the products formed in the two tests were substantially equivalent. However, in carrying out the method of U.S. Pat. No. 2,761,791 the total drying load involved in drying the two layers that were coated was 45.2 grams of water per second per centimeter of web width, whereas in carrying out the method of this invention the total drying load involved in drying the three layers that were coated was 26.1 grams of water per second per centimeter of web width. This represents a reduction in drying load of 42 percent by using the method of this invention as compared to using the method of U.S. Pat. No. 2,761,791. As an alternative to utilizing the method of this invention to achieve a reduction in drying load one can utilize the method of this invention to permit the use of a higher coating speed for a fixed drying load. Thus, in the comparative example given above, the drying load for operation of the method of U.S. Pat. No. 2,761,791 at a web speed of 190 centimeters per second is the same as the drying load for operation of the method of this invention at a web speed of 328 centimeters per second which represents an increase in speed of 73%.

The invention has been described in detail with particular reference to preferred embodiments thereof, but it will be understood that variations and modifications can be effected within the spirit and scope of the invention.

What is claimed is:

1. In a method of simultaneously applying a plurality of layers of liquid coating compositions to a moving web in which each of said compositions is fed into a coating bead which is maintained in bridging relationship between the surface of said web and a coating device spaced therefrom and the surface of said web is continuously moved across and in contact with said coating bead to simultaneously pick up all of said layers, the improvement wherein the speed of the web is at least 100 centimeters per second, the lowermost layer is thin and formed of a coating composition of low viscosity, and the layer immediately above the lowermost layer is thicker than the lowermost layer and formed of a coating composition of higher viscosity; the thickness and viscosity of the lowermost layer and of the layer immediately above it being such that vortical of said coating bead is confined within the lowermost layer and the layer immediately above it, whereby interlayer mixing occurs between the lowermost layer and the layer immediately above it but all other layers are coated in distinct layer relationship.

2. In a method of manufacturing a photographic element by simultaneously applying a plurality of layers of liquid photographic coating compositions to a moving web of photographic support material in which each of said compositions is fed into a coating bead which is maintained in bridging relationship between the surface of said web and a coating device spaced therefrom and the surface of said web is continuously moved across and in contact with said coating bead to simultaneously pick up all of said layers, the improvement wherein the speed of the web is at least 100 centimeters per second, the lowermost layer is thin and formed of a coating composition of low viscosity, and the layer immediately above the lowermost layer is thicker than the lowermost layer and formed of a coating composition of higher viscosity; the thickness and viscosity of the lowermost layer and of the layer immediately above it being such that vortical action of said coating bead is confined within the lowermost layer and the layer immediately above it, whereby interlayer mixing occurs between the lowermost layer and the layer immediately above it but all other layers are coated in distinct layer relationship.

3. The method of claim 2 wherein the wet coverage of the lowermost layer is in the range from about 2 to about 12 cubic centimeters of coating composition per square meter of web surface and the lowermost layer is formed from a coating composition with a viscosity in the range from about 1 to about 8 centipoises.

4. The method of claim 3 wherein the wet coverage of the layer immediately above the lowermost layer is in the range from about 15 to about 50 cubic centimeters of coating composition per square meter of web surface and the layer immediately above the lowermost layer is formed from a coating composition with a viscosity in the range from about 10 to about 100 centipoises.

5. The method of claim 2 wherein the wet coverage of the lowermost layer is in the range from about 5 to about 10 cubic centimeters of coating composition per square meter of web surface, the lowermost layer is formed from a coating composition with a viscosity in the range from about 3 to about 5 centipoises, the wet coverage of the layer immediately above the lowermost layer is in the range from about 20 to about 35 cubic centimeters of coating composition per square meter of web surface, and the layer immediately above the lowermost layer is formed from a coating composition with a viscosity in the range from about 30 to about 70 centipoises.

6. The method of claim 2 wherein the coating composition from which the lowermost layer is formed in a dilute gelatin solution.

7. The method of claim 2 wherein the coating composition from which the lowermost layer is formed is a dispersion of a coupler solvent in a hydrophilic colloid.

8. The method of claim 2 wherein the coating composition used to form the layer immediately above the lowermost layer is a gelatino/silver halide emulsion.

9. The method of claim 2 wherein the coating compositions used to form the lowermost layer and the layer immediately above it are each gelatino/silver halide emulsion but the composition used to form the lowermost layer is more dilute than that used to form the layer immediately above it.

10. The method of claim 2 wherein said support is a cellulose acetate support.

11. The method of claim 2 wherein said support is a polyester support.

12. The method of claim 2 wherein said support is a polymer-coated paper support.

13. The method of claim 2 wherein said support is a polyethylene-coated paper support.

14. The method of claim 2 wherein the coating composition forming the lowermost layer contains a surfactant.

15. The method of claim 2 wherein the lowermost layer is formed from a dilute gelatin solution having a viscosity in the range of from about 3 to about 5 centipoises coated at a wet coverage in the range from about 5 to about 10 cubic centimeters per square meter of web surface and the layer immediately above the lowermost layer is formed from a gelantino/silver halide emulsion having a viscosity in the range of from about 30 to about 70 centipoises coated at a wet coverage in the range from about 20 to about 35 cubic centimeters per square meter of web surface.

* * * * *

UNITED STATES PATENT AND TRADEMARK OFFICE

CERTIFICATE OF CORRECTION

PATENT NO. : 4,001,024

DATED : January 4, 1977

INVENTOR(S) : Donald A. Dittman et al

It is certified that error appears in the above-identified patent and that said Letters Patent are hereby corrected as shown below:

Column 1, lines 50 and 51, "vertical" should be -- vortical --.

Column 2, line 2, "dying" should be -- drying --.

Column 3, line 14, the second occurrence of the word "in" should be -- is --.

Column 5, line 45, "is" should be -- it --; line 46, "additonal" should be -- additional --; line 65, "It" should be -- it --.

Column 6, line 31, "caot" should be -- coat --.

Column 7, line 18, "composition" should be -- compositions --; line 45, "Mixture" should be -- Mixtures --.

Column 9, line 13, "colores" should be -- colors --.

UNITED STATES PATENT AND TRADEMARK OFFICE

CERTIFICATE OF CORRECTION

PATENT NO. : 4,001,024

DATED : January 4, 1977

INVENTOR(S) : Donald A. Dittman et al

It is certified that error appears in the above-identified patent and that said Letters Patent are hereby corrected as shown below:

Claim 1, in the sixteenth line thereof, after "vortical" insert -- action --.

Claim 6, in the second line thereof, "in" should be -- is --.

Claim 9, in the fourth line thereof, "emulsion" should be -- emulsions"--.

Claim 15, in the seventh line thereof, "gelantino" should be -- gelatino --.

Signed and Sealed this

Thirtieth Day of October 1979

[SEAL]

Attest:

RUTH C. MASON
Attesting Officer

LUTRELLE F. PARKER
Acting Commissioner of Patents and Trademarks